US008657616B2

(12) United States Patent
Raistrick et al.

(10) Patent No.: US 8,657,616 B2
(45) Date of Patent: Feb. 25, 2014

(54) ELECTRICAL CONTACT NORMAL FORCE INCREASE

(75) Inventors: Alan Raistrick, Rockville, MD (US); Stuart C. Stoner, Lewisberry, PA (US)

(73) Assignee: FCI Americas Technology LLC, Carson City, NV (US)

( * ) Notice: Subject to any disclaimer, the term of this patent is extended or adjusted under 35 U.S.C. 154(b) by 97 days.

(21) Appl. No.: 13/462,362

(22) Filed: May 2, 2012

(65) Prior Publication Data

US 2012/0302108 A1 Nov. 29, 2012

Related U.S. Application Data

(60) Provisional application No. 61/489,414, filed on May 24, 2011.

(51) Int. Cl.
*H01R 13/15* (2006.01)

(52) U.S. Cl.
USPC ..... 439/259; 439/261; 439/78; 439/108

(58) Field of Classification Search
USPC ..... 439/259, 261, 78, 108
See application file for complete search history.

(56) References Cited

U.S. PATENT DOCUMENTS

| | | | | |
|---|---|---|---|---|
| 3,489,986 | A * | 1/1970 | Frederick | 439/264 |
| 3,585,573 | A | 6/1971 | Robshaw | 339/176 |
| 4,514,032 | A | 4/1985 | Lawrence | 339/278 |
| 4,781,611 | A * | 11/1988 | Leonard | 439/259 |
| 4,857,018 | A | 8/1989 | Pickles | 439/751 |
| 5,067,916 | A | 11/1991 | Denlinger et al. | 439/857 |
| 5,167,528 | A | 12/1992 | Nishiyama et al. | 439/489 |
| 6,224,411 | B1 * | 5/2001 | Maag | 439/259 |
| 6,869,292 | B2 | 3/2005 | Johnescu et al. | 439/74 |
| 7,226,298 | B1 | 6/2007 | Minich | |
| 7,503,804 | B2 | 3/2009 | Minich et al. | 439/608 |
| 7,524,209 | B2 | 4/2009 | Hull et al. | 439/608 |
| 7,621,779 | B2 | 11/2009 | Laurx et al. | 439/607.07 |
| 7,762,843 | B2 | 7/2010 | Minich et al. | 439/607.05 |
| 2003/0219999 | A1 | 11/2003 | Minich et al. | |
| 2004/0043672 | A1 | 3/2004 | Shuey et al. | |
| 2008/0176453 | A1 | 7/2008 | Minich et al. | |
| 2010/0055933 | A1 | 3/2010 | Laurx et al. | |
| 2010/0055988 | A1 | 3/2010 | Shuey et al. | 439/660 |

FOREIGN PATENT DOCUMENTS

WO 2009012089 A2 1/2009

* cited by examiner

*Primary Examiner* — Gary F. Paumen
(74) *Attorney, Agent, or Firm* — Harrington & Smith

(57) ABSTRACT

An electrical connector including a housing; and a plurality of first ground contacts. The first ground contacts each comprise a male contact blade configured to be inserted into a contact channel of a housing of a mating electrical connector. The male contact blade has a portion configured to contact the housing of the mating electrical connector, after the male contact blade makes electrical contact with the deflectable beam, to move the male contact blade in the contact channel, increase deflection of the deflectable beam by the male contact blade, and increase or maintain normal force between the mating contact and the ground contact generally.

21 Claims, 7 Drawing Sheets

ELECTRICAL CONTACT NORMAL FORCE INCREASE

CROSS REFERENCE TO RELATED APPLICATION

This application claims the benefit under 35 USC 119(e) of U.S. Provisional Patent Application No. 61/489,414 filed May 24, 2011, which is hereby incorporated by reference in its entirety.

BACKGROUND

1. Technical Field

The exemplary and non-limiting embodiments of the invention relate generally to an electrical connector and, more particularly, to connection between two contacts.

2. Brief Description of Prior Developments

U.S. Pat. No. 7,621,779 discloses an electrical connector having header terminals with flat blades and offset bends having stamped ribs.

SUMMARY

The following summary is merely intended to be exemplary. The summary is not intended to limit scope.

In accordance with one aspect, an electrical connector is provided comprising a housing; and a plurality of first ground contacts connected to the housing. The first ground contacts each comprise a first end configured to be connected to a first component and a second end. The second end forms a male contact blade configured to be inserted into a contact channel of a housing of a mating electrical connector. The male contact blade is configured to make a removable connection with a deflectable beam of a mating contact of the mating electrical connector. The male contact blade has a portion configured to contact the housing of the mating electrical connector during connection of the electrical connector to the mating electrical connector, after the male contact blade makes electrical contact with the deflectable beam, to move the male contact blade in the contact channel, increase deflection of the deflectable beam by the male contact blade, and increase normal force, or maintain normal force, between the mating contact and the ground contact generally perpendicular to a direction of insertion of the male contact blade into the contact channel.

In accordance with another aspect, an electrical connector is provided comprising a housing; a plurality of ground contacts connected to the housing, where the ground contacts comprise first male contact blades; and a plurality of signal contacts connected to the housing. The signal contacts comprise second male contact blades at a same side of the housing as the first male contact blades. The signal contacts and the ground contacts are formed from one or more sheet metal members having a same thickness such that the first and second male contact blades have a same thickness. Each of the first male contact blades have a portion configured to contact a housing of a mating electrical connector during connection of the electrical connector to the mating electrical connector which, after the first male contact blade makes electrical contact with a deflectable beam of a mating contact in the mating electrical connector and after a majority of insertion of the first male contact blade into the mating electrical connector, and during further insertion of the ground contact into the housing of the mating electrical connector contact, causes the first male contact blade to move in a direction to increase deflection of the deflectable beam and thereby increase normal force, or maintain normal force, between the deflectable beam and the first male contact blade.

In accordance with another aspect, a method comprises inserting first male contact blades of a plurality of ground contacts of a first electrical connector into first contact channels of a second electrical connector; and inserting second male contact blades of a plurality of signal contacts of the first electrical connector into second contact channels of the second electrical connector. The ground and signal contacts are formed from one or more sheet metal members having a same thickness such that the first and second male contact blades have a substantially same thickness. After the first and second male contact blades have moved deflectable beams of mating contacts of the second electrical connector and slid along the deflectable beams along a majority of length of the first and second male contact blades, a portion of the first male contact blades contacts a housing of the second electrical connector and, with further insertion of the first male contact blade into the second electrical connector, the portion and the housing cause the first male contact blade to deflect and move the respective deflectable beams to increase normal force, or maintain normal force.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
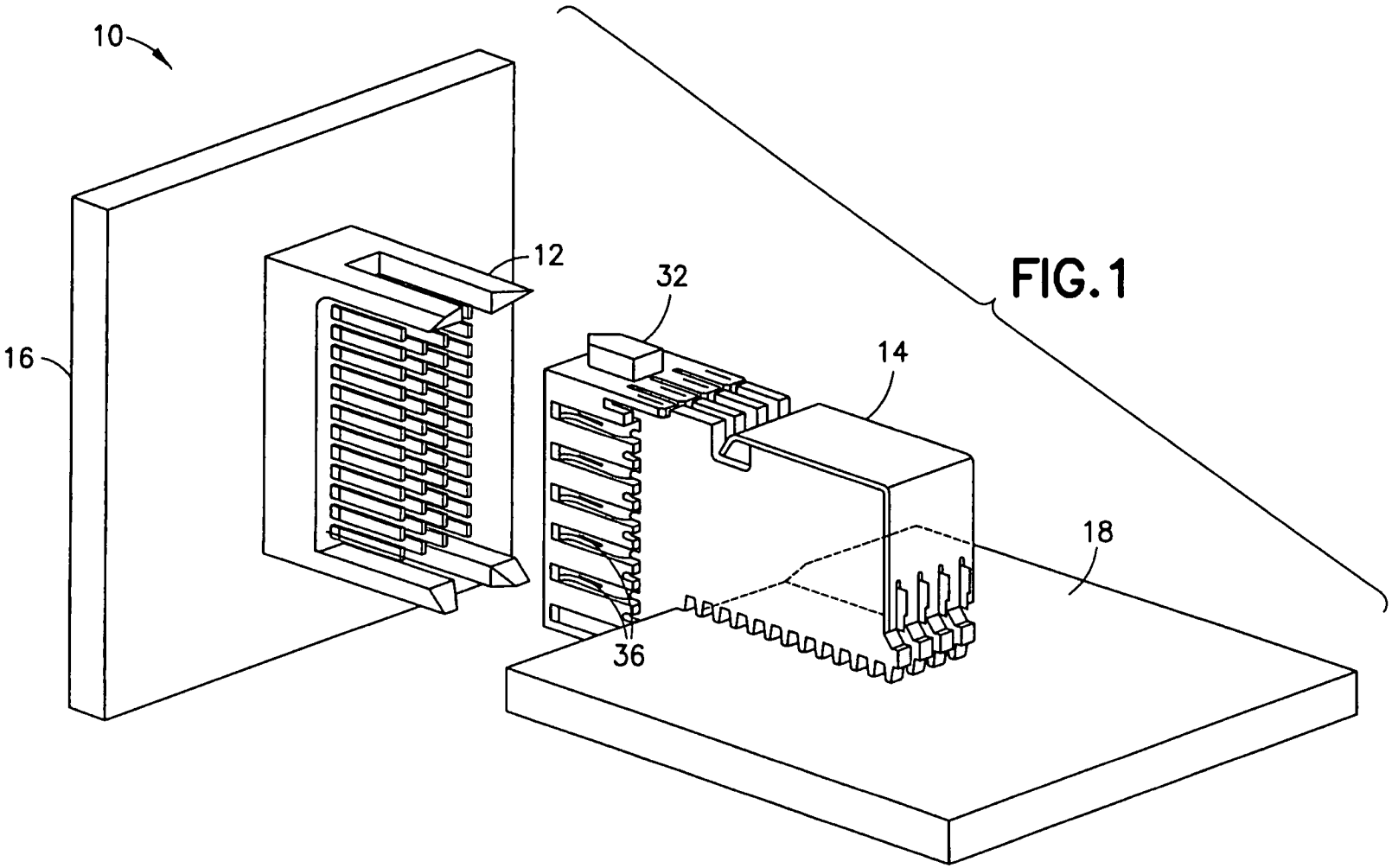
FIG. 1 is a perspective view of connectors and components used to make an assembly.

Referring to FIG. 1, an assembly 10 is shown, partially separated, which comprises features of an example embodiment. Although features will be described with reference to the example embodiments shown in the drawings, it should be understood that features can be embodied in many alternate forms of embodiments. In addition, any suitable size, shape or type of elements or materials could be used.

The assembly 10 generally comprises two electrical connectors 12, 14 which are used to removably connect two components 16, 18 (such as printed circuit boards for example) to each other. The first connector 12 is a backpanel connector, and the second connector 16 is a right angle connector. However, in alternate embodiments the connectors 12, 14 could be any suitable right angle or vertical type of connector as further understood from the description below. In this example, both connectors have contacts which comprise through hole mounting posts to be located in holes of the printed circuit boards 16, 18. However, in alternate embodiments the contacts might comprise other types of component connection areas, such as surface mounted contact areas.

Figure 2:
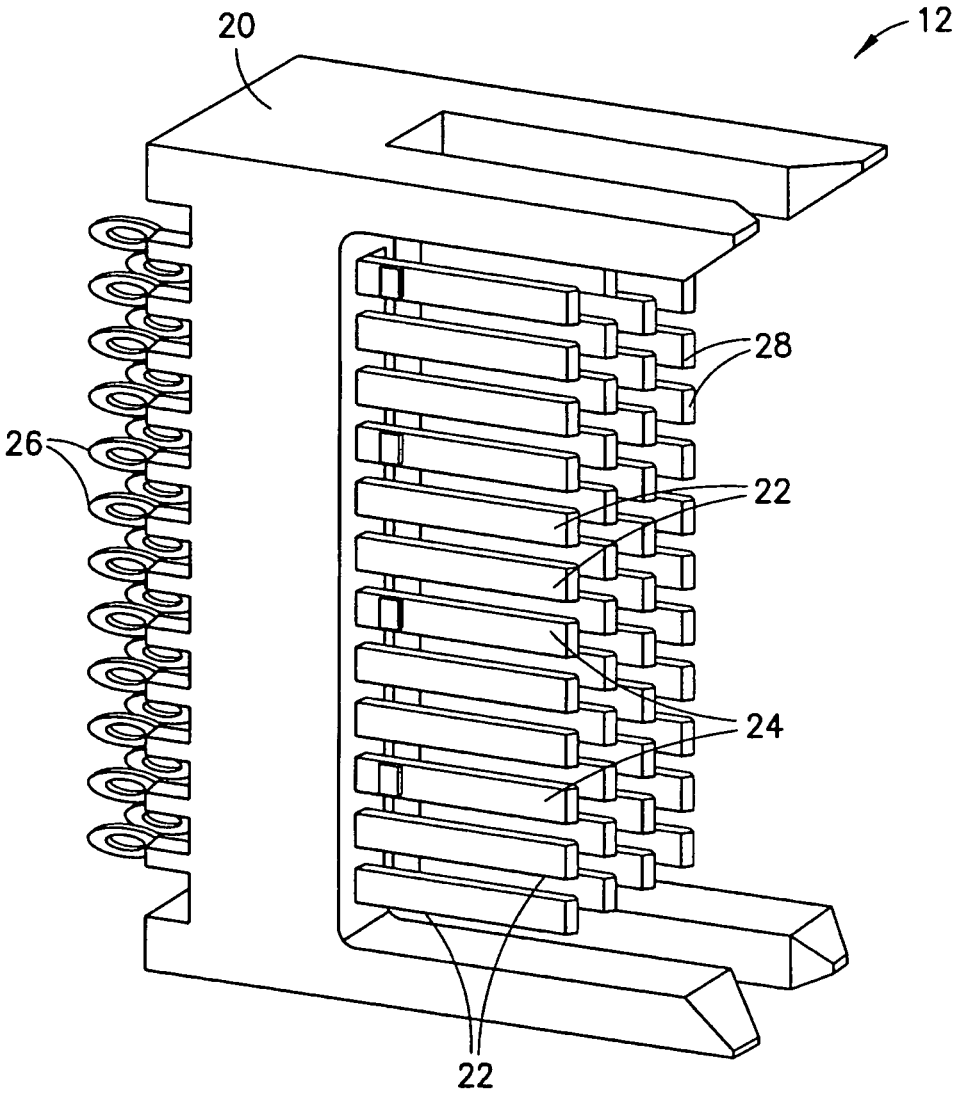
FIG. 2 is a perspective view of one of the electrical connectors shown in FIG. 1.
Figure 3:
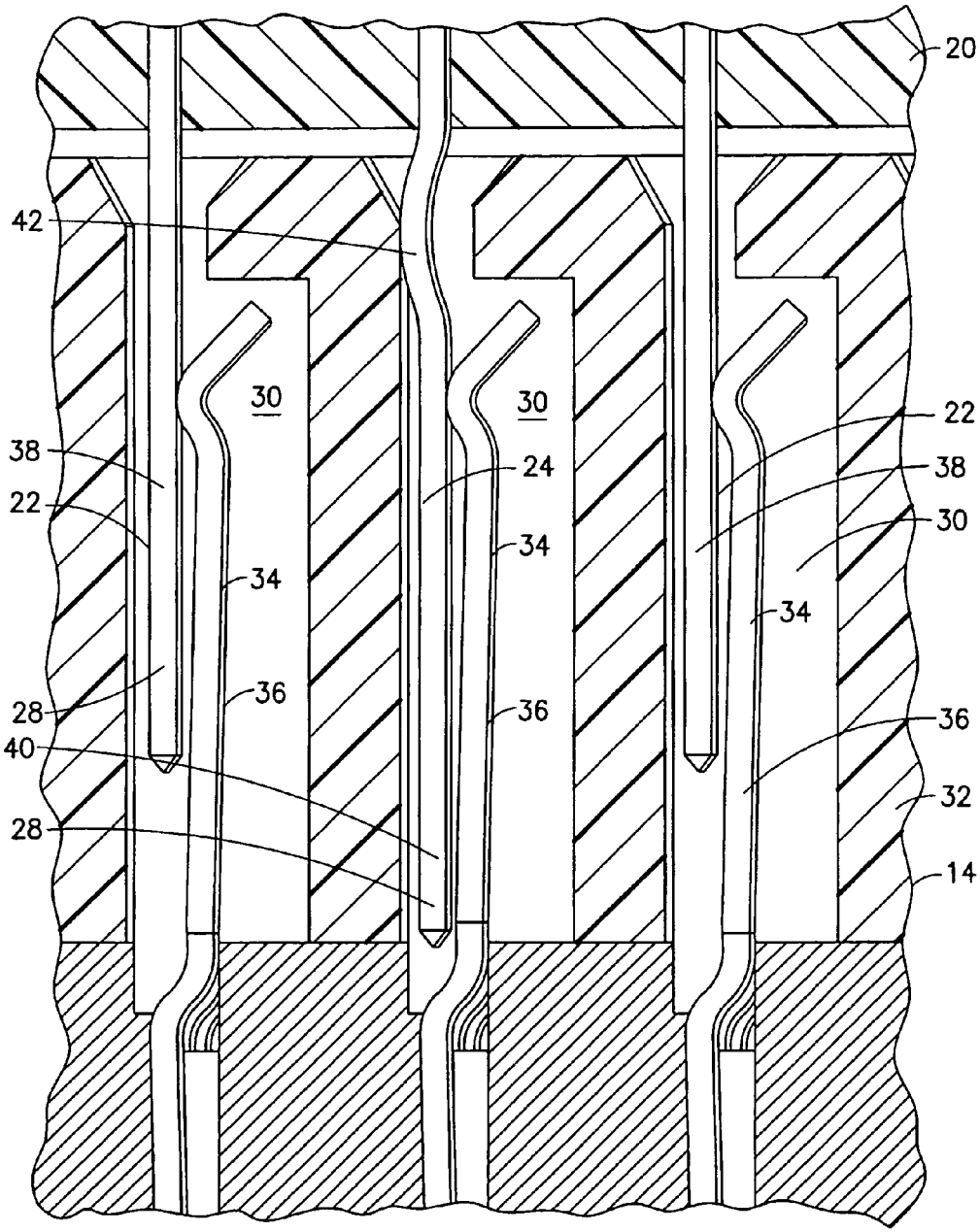
FIG. 3 is a cross sectional view of a portion of the two electrical connectors shown in FIG. 1 illustrating connection.

Referring also to FIG. 2, an enlarged view of the first connector 12 is shown. The first connector 12 is a header connector and comprises a housing 20, signal contacts 22 and ground contacts 24. In this example embodiment the connector 12 is a high speed connector having matched pairs of signal contacts. However, features of the invention can be used in other types of connectors. The contacts 22, 24 have first ends 26 and second ends 28. The first ends 26 are configured to be connected to the component 16. In this example the first ends 26 are through-hole press-fit tails. However, in an alternate embodiment any suitable first end could be used, such as a surface mounted solder tail for example. Referring also to FIG. 3, the second ends 28 forms male contact blades configured to be inserted into a contact channel 30 of a housing 32 of the mating electrical connector 14. The male contact blades are each configured to make a removable connection with a deflectable beam 34 of a mating contact 36 of the mating electrical connector 14.

The signal and ground contacts 22, 24 in this example are formed for a sheet metal member which has been stamped and formed. Thus, the contacts 22, 24 have substantially the same cross sectional thickness, such as 2 mm for example. A column of the contacts are preferably provided on a single lead frame with intermixed signal and ground contacts 22, 24. In this fashion the contacts 22, 24 can be stitched as a single column together into the housing 20 in one operation, or the housing 20 can be overmolded onto the contacts while the contacts are on a leadframe; and the contacts 22, 24 in the column can be subsequently electrically separated from each other by cutting out portions of the leadframe.

In this example embodiment, the signal contacts 22 have a male contact blade 38 which is substantially straight with a uniform cross sectional shape except at its distal tip. The male contact blade 38 extends forward from the housing 20 in a general cantilever fashion.

In this example embodiment, the ground contacts have a male contact blade 40 which is substantially straight for a majority of its length. The male contact blade 40, because it is stamped from sheet metal, has a substantially uniform cross sectional shape along its length except at its distal tip. The male contact blade extends forward from the housing 20 in a general cantilever fashion. In the example shown, as illustrated by FIG. 3, at least one of the male contact blades of the ground contacts 24 has a longer length than the male contact blade of the signal contacts 22. However, this need not be provided.

Figure 4:
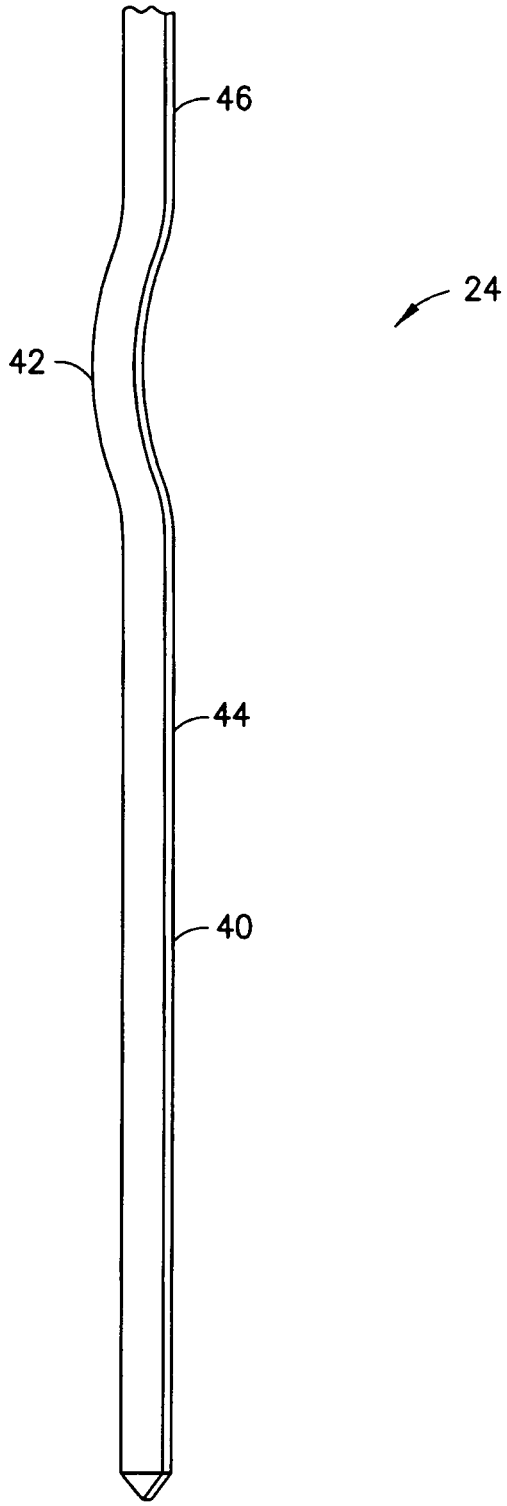
FIG. 4 is a side view of one of the ground contacts shown in FIGS. 1-3.

Referring also to FIG. 4, although a majority of the male contact blade 40 is straight along its length, each male contact blade 40 has a portion 42 which is not straight. The portion 42 has a general bend or curve shape along the longitudinal length proximate the rear end of the male contact blade 40. The bend of the portion 40 may also strengthen the blade 40. The cross sectional shape of the contact at the portion 42 is still substantially uniform with the rest of the male contact blade; such as rectangularly flat for example. The portion 42 in this example is formed merely by stamping a bend into the contact. Sections 44 and 46 located in front of and behind the portion 42 are substantially coaxially aligned.

As seen in FIG. 3, the portion 42 is configured to contact the housing 32 of the mating electrical connector 14 during connection of the electrical connector 12 to the mating electrical connector 14. This contact occurs after the male contact blade 40 makes electrical contact with its respective deflectable beam 34. As further described below, this contact of the portion 42 on the housing 32 moves the male contact blade in the contact channel 30 to increase deflection of the deflectable beam 34 by the male contact blade 40, and increase normal force, or maintain normal force, between the mating contact 36 and the ground contact 24 generally perpendicular to a direction of insertion of the male contact blade into the contact channel.

Figure 5:
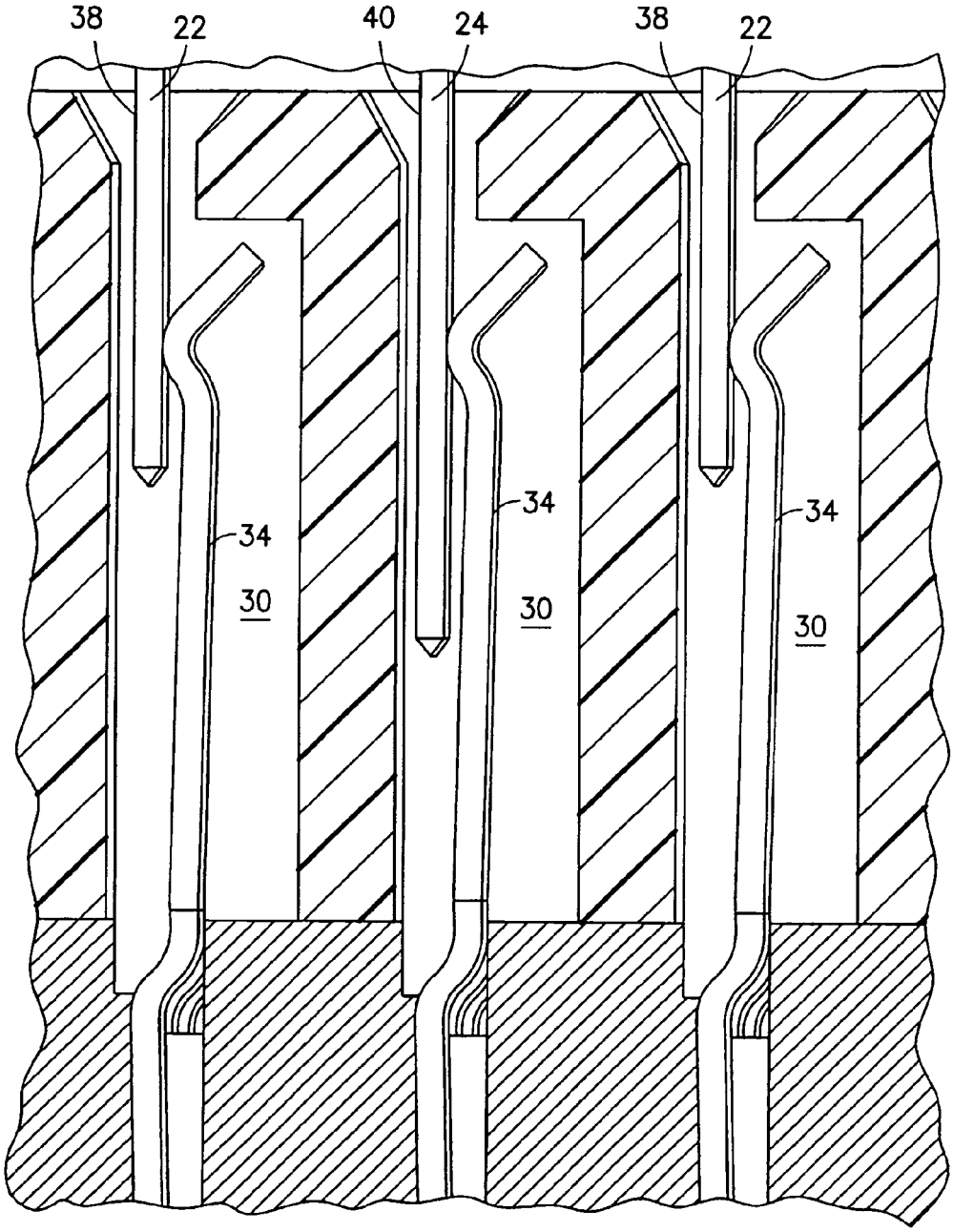
FIG. 5 is a cross sectional view of a portion of the two electrical connectors shown in FIG. 1 similar to FIG. 3 but illustrating an initial connection.
Figure 6:
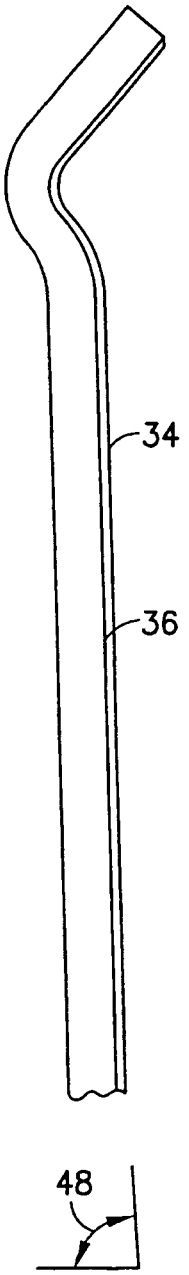
FIG. 6 is a side view of one of the deflectable beams of the second mating connector shown in FIGS. 1, 3 and 5 at an unmated home position.
Figure 7:
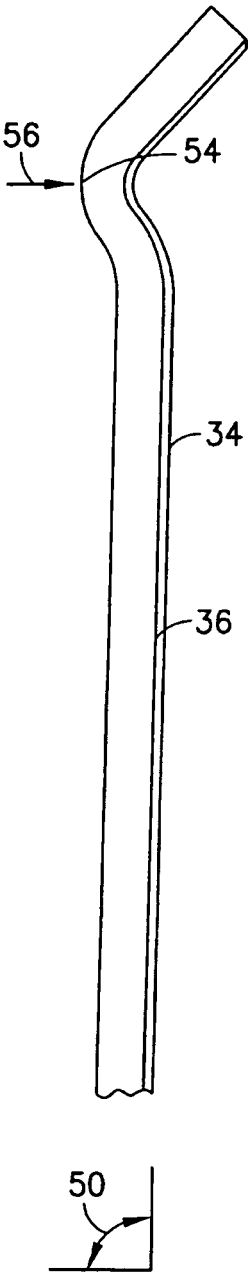
FIG. 7 is a side view of the deflectable beam shown in FIG. 6 at an initial deflected position corresponding to the position shown in FIG. 5.

Referring also to FIG. 5, when the male contact blades 38, 40 are initially inserted into the channels 30, the front tips of the blades 38, 40 contact the deflectable beams 34 and deflect the beams 34 out of the path of the blades 38, 40 generally perpendicular to the path of insertion of the blades. Referring also to FIG. 6, before the blades are inserted into the channels 30, the deflectable beams 34 are initially at an angle 48. When the blades 38, 40 initially displace the beams 34 as illustrated in FIG. 5, the angle increases to 50 as indicated in FIG. 7. Slight bowing of the beam 34 may occur. The beams 34 make contact with their respective blades 38 or 40 at contact area 54, and arrow 56 illustrates the normal force against the contact area 54.

Figure 8:
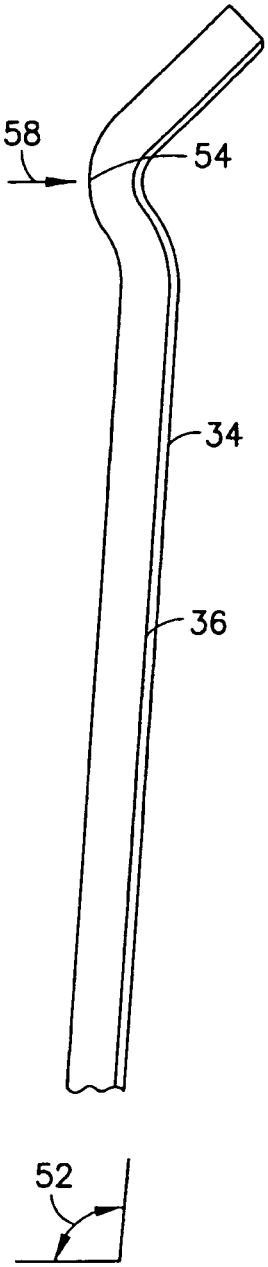
FIG. 8 is a side view of the deflectable beam shown in FIGS. 6 and 7 at a final deflected position corresponding to the position shown in FIG. 3 with the ground contact.

As the two connectors 12, 14 continue to mate the blades 38, 40 are further inserted into the channels 30 with the beams 34 wiping against the blades. Finally, towards the end of mating of the connectors 12, 14, the portion 42 of the ground contact 24 contacts the housing 32 as shown in FIG. 3. This contact causes the beam 40 to deflect in a general cantilever fashion towards its respective deflectable beam of the mating contact 36. As illustrated in FIG. 8, this causes the angle of deflection of the deflectable beam 34 to increase further to angle 52. The deflection of the blade 40, by contact of the portion 42 and housing 32, and the resultant further deflection of its respective deflectable beam by the mating contact 36, increases normal force between the blade 40 and its respective deflectable beam 34 to a larger normal force 58, such as to compensate for other influences such as vibrations or fatigue for example. This increased normal force only occurs at the blade 40 of the ground contact 24. The signal contacts 22 are substantially unaffected.

Figure 9:
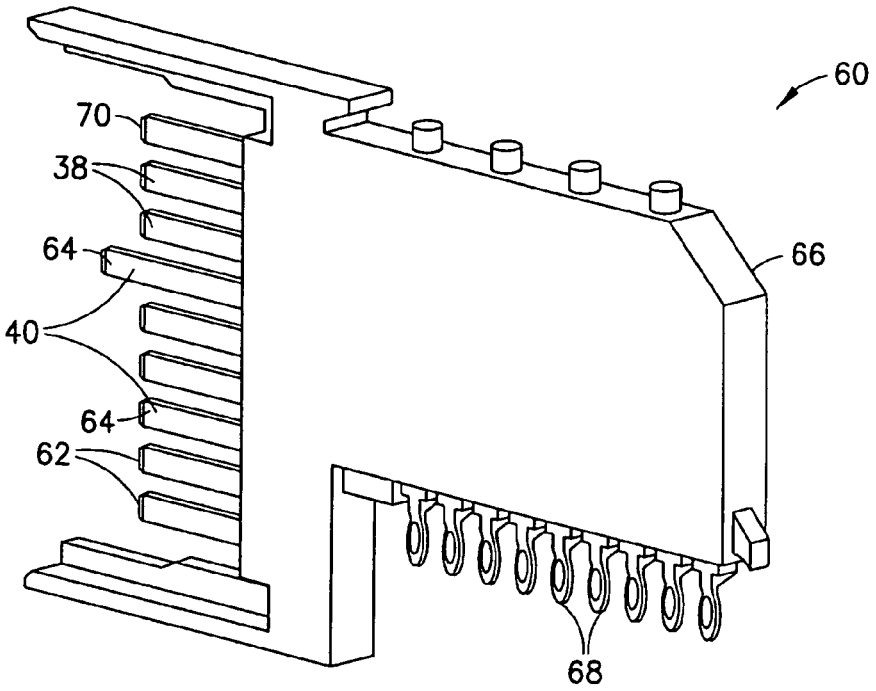
FIG. 9 is a perspective view of an alternate example embodiment.
Figure 10:
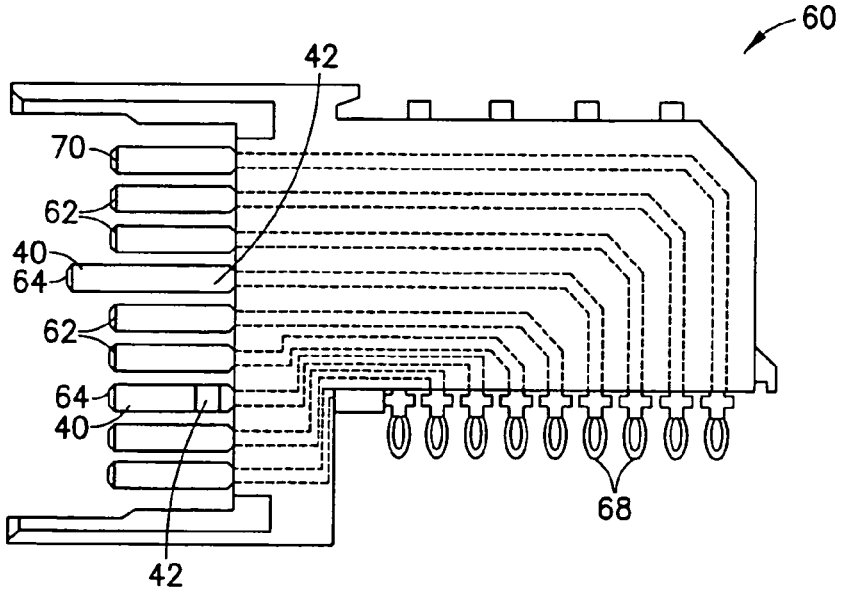
FIG. 10 is a side view of the embodiment shown in FIG. 9.

Referring also to FIGS. 9-10, an alternate example embodiment is shown. FIGS. 9 and 10 show an Insert Molded Leadframe Assemblies (IMLAs) 60. Multiple IMLAs are used to assemble a connector similar to the electrical connectors described in U.S. Pat. Nos. 7,524,209 and 6,869,292 B2 and U.S. patent publication No. 2010/0055988 A1 which are hereby incorporated by reference in their entireties. In the example shown, the IMLA is a right angle component used to manufacture a right angle connector. The IMLA comprises multiple signal contacts 62, ground contacts 64 and an overmolded housing 66.

The contacts 62, 64 have first ends 68 and second ends 70. The first ends 68 are configured to be connected to the component, such as component 16. In this example the first ends 68 are through-hole press-fit tails. However, in an alternate embodiment any suitable first end could be used, such as a surface mounted solder tail for example. The second ends 70 forms male contact blades configured to be inserted into a contact channel of a housing of the mating electrical connector. The male contact blades are each configured to make a removable connection with a deflectable beam of a mating contact of the mating electrical connector.

The signal and ground contacts 62, 64 in this example are formed for a sheet metal member which has been stamped and formed. Thus, the contacts 62, 64 have substantially the same cross sectional thickness, such as mm for example. A column of the contacts are preferably provided on a single lead frame with intermixed signal and ground contacts 62, 64. In this fashion the housing 66 can be overmolded onto the contacts while the contacts are on a leadframe; and the contacts 62, 64 in the column subsequently electrically separated from each other by cutting out portions of the leadframe.

In this example embodiment, the signal contacts 62 have a male contact blade 38 which is substantially straight with a uniform cross sectional shape except at its distal tip. The male contact blade 38 extends forward from the housing 66 in a general cantilever fashion.

In this example embodiment, the ground contacts 64 have a male contact blade 40 which is substantially straight for a majority of its length. The male contact blade 40, because it is stamped from sheet metal, has a substantially uniform cross sectional shape along its length except at its distal tip. The male contact blade 40 extends forward from the housing 20 in a general cantilever fashion. In the example shown at least one of the male contact blades of the ground contacts has a longer length than the male contact blade of the signal contacts.

Although a majority of the male contact blade 40 is straight along its length, each male contact blade 40 has a portion 42 which is not straight. The portion 42 has a general bend or curve shape along the longitudinal length proximate the rear end of the male contact blade 40. The cross sectional shape of the contact at the portion 42 is still substantially uniform with the rest of the male contact blade; such as rectangularly flat for example. The portion 42 in this example is formed merely by stamping a bend into the contact. Sections 44 and 46 (see FIG. 4) located in front of and behind the portion 42 are substantially coaxially aligned.

In accordance with one example embodiment, an electrical connector 12 is provided comprising a housing 20; and a plurality of first ground contacts 24 connected to the housing, where the first ground contacts each comprise a first end 26 configured to be connected to a first component 16 and a second end 28, where the second end 28 forms a male contact blade 40 configured to be inserted into a contact channel 30 of a housing 32 of a mating electrical connector 14, where the male contact blade 40 is configured to make a removable connection with a deflectable beam 34 of a mating contact 36 of the mating electrical connector 14, where the male contact blade 40 has a portion 42 configured to contact the housing 32 of the mating electrical connector 14 during connection of the electrical connector to the mating electrical connector, after the male contact blade makes electrical contact with the deflectable beam, to move the male contact blade in the contact channel, increase deflection of the deflectable beam by the male contact blade, and increase normal force 56/58 between the mating contact and the ground contact generally perpendicular to a direction of insertion of the male contact blade into the contact channel.

The portion may comprise a lateral jog in a rear end of the male contact blade. The ground contacts may be formed from one or more sheet metal members such that the male contact blade has a cross sectionally flat shape, and where the portion comprises a bent portion of the cross sectionally flat shaped male contact blade. The portion may comprise a general lateral rounded hill shape. The male contact blade may be substantially straight except for the portion, where the portion extends laterally outward from a center axis of the substantially straight male contact blade between coaxially aligned front and rear sections of the male contact blade which are located on opposite ends of the portion. The portion may be sized and shaped to cause the male contact blade to pivotably deflect in a general cantilever fashion proximate a rear end of the male contact blade as the portion contacts and moves along the housing of the mating electrical connector. The electrical connector may further comprise second signal contacts connected to the housing, where the signal contacts comprise male contacts blades at a same side of the housing as the male contacts blades of the first ground contacts, where the signal contacts and the ground contacts are formed from one or more sheet metal members having a same thickness such that the male contact blades of the first ground contacts and second signal contacts have a substantially same thickness. The male contact blades of the second signal contacts may be straight without the portion. The connector may be used in an assembly comprising a mating electrical connector connected to the electrical connector, where the mating electrical connector comprises a housing with contact channels, and mating contacts with deflectable beams. The mating contacts may comprise mating ground contacts having their respective deflectable beams on only one side of the first ground contacts.

Another example can be provided in an electrical connector comprising a housing 20 or 66; a plurality of ground contacts 24 or 64 connected to the housing, where the ground contacts comprise first male contact blades; and a plurality of signal contacts 22 or connected to the housing, where the signal contacts comprise second male contact blades at a same side of the housing as the first male contact blades, where the signal contacts and the ground contacts are formed from one or more sheet metal members having a same thickness such that the first and second male contact blades have a same thickness, where, each of the first male contact blades have a portion configured to contact a housing of a mating electrical connector during connection of the electrical connector to the mating electrical connector which, after the first male contact blade makes electrical contact with a deflectable beam of a mating contact in the mating electrical connector and after a majority of insertion of the first male contact blade into the mating electrical connector, and during further insertion of the ground contact into the housing of the mating electrical connector contact, causes the first male contact blade to move in a direction to increase deflection of the deflectable beam and thereby increase normal force between the deflectable beam and the first male contact blade.

The portion 42 may comprise a lateral jog proximate a rear end of the first male contact blades. The ground contacts may have a cross sectionally flat shape, and where the portion comprises a bent portion of the cross sectionally flat shaped first male contact blade. The portion may comprise a general lateral extending arc shape. The first male contact blade may be substantially straight except for the portion, where the portion extends laterally outward from a center axis of the substantially straight first male contact blade between coaxially aligned front and rear sections of the first male contact blade which are located on opposite ends of the portion. The portion may be sized and shaped to cause the first male contact blade to pivotably deflect in a general cantilever fashion proximate a rear end of the first male contact blade as the portion contacts and moves along the housing of the mating electrical connector. The second male contact blades of the signal contacts may be straight without the portion.

An example method may comprise inserting first male contact blades 40 of a plurality of ground contacts of a first electrical connector into first contact channels of a second electrical connector; and inserting second male contact blades 38 of a plurality of signal contacts of the first electrical connector into second contact channels of the second electrical connector, where the ground and signal contacts are formed from one or more sheet metal members having a same thickness such that the first and second male contact blades have a substantially same thickness, where, after the first and second male contact blades have moved deflectable beams 34 of mating contacts of the second electrical connector and slide along the deflectable beams along a majority of length of the first and second male contact blades, a portion 42 of the first male contact blades contacts a housing of the second electrical connector and, with further insertion of the first male contact blade into the second electrical connector, the portion and the housing cause the first male contact blade to deflect and move the respective deflectable beams to increase normal force.

Another example may be provided in an electrical connector comprising a housing; and a plurality of first contacts connected to the housing. The first contacts might not be ground contacts. The first contacts might comprise a signal contact or a power contact for example. The first contacts may each comprise a first end configured to be connected to a first component and a second end, where the second end forms a male contact blade configured to be inserted into a contact channel of a housing of a mating electrical connector, where the male contact blade is configured to make a removable connection with a deflectable beam of a mating contact of the mating electrical connector. The male contact blade may have a portion configured to contact the housing of the mating electrical connector during connection of the electrical connector to the mating electrical connector, after the male contact blade makes electrical contact with the deflectable beam, to move the male contact blade in the contact channel, increase deflection of the deflectable beam by the male contact blade, and increase or maintain normal force between the mating contact and the contact generally perpendicular to a direction of insertion of the male contact blade into the contact channel.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. An electrical connector comprising:

a housing; and a plurality of first ground contacts connected to the housing, where the first ground contacts each comprise a first end configured to be connected to a first component and a second end, where the second end forms a male contact blade configured to be inserted into a contact channel of a housing of a mating electrical connector, where the male contact blade is configured to make a removable connection with a deflectable beam of a mating contact of the mating electrical connector, where the male contact blade has a portion configured to contact the housing of the mating electrical connector during connection of the electrical connector to the mating electrical connector, after the male contact blade makes electrical contact with the deflectable beam, to move the male contact blade in the contact channel, increase deflection of the deflectable beam by the male contact blade, and increase or maintain normal force between the mating contact and the ground contact generally perpendicular to a direction of insertion of the male contact blade into the contact channel.

2. An electrical connector as in claim 1 where the portion comprises a lateral jog in a rear end of the male contact blade.

3. An electrical connector as in claim 1 where the ground contacts are formed from one or more sheet metal members such that the male contact blade has a cross sectionally flat shape, and where the portion comprises a bent portion of the cross sectionally flat shaped male contact blade.

4. An electrical connector as in claim 3 where the portion comprise a general lateral rounded hill shape.

5. An electrical connector as in claim 1 where the male contact blade is substantially straight except for the portion, where the portion extends laterally outward from a center axis of the substantially straight male contact blade between coaxially aligned front and rear sections of the male contact blade which are located on opposite ends of the portion.

6. An electrical connector as in claim 1 where the portion is sized and shaped to cause the male contact blade to pivotably deflect in a general cantilever fashion proximate a rear end of the male contact blade as the portion contacts and moves along the housing of the mating electrical connector.

7. An electrical connector as in claim 1 further comprising second signal contacts connected to the housing, where the signal contacts comprise male contacts blades at a same side of the housing as the male contacts blades of the first ground contacts, where the signal contacts and the ground contacts are formed from one or more sheet metal members having a same thickness such that the male contact blades of the first ground contacts and second signal contacts have a substantially same thickness.

8. An electrical connector as in claim 7 where the male contact blades of the second signal contacts are straight without the portion.

9. An assembly comprising:

an electrical connector as in claim 7; and a mating electrical connector connected to the electrical connector, where the mating electrical connector comprises a housing with contact channels, and mating contacts with deflectable beams.

10. An assembly as in claim 9 where the mating contacts comprise mating ground contacts having their respective deflectable beams on only one side of the first ground contacts.

11. An electrical connector comprising:

a housing;

a plurality of ground contacts connected to the housing, where the ground contacts comprise first male contact blades; and a plurality of signal contacts connected to the housing, where the signal contacts comprise second male contact blades at a same side of the housing as the first male contact blades, where the signal contacts and the ground contacts are formed from one or more sheet metal members having a same thickness such that the first and second male contact blades have a same thickness, where, each of the first male contact blades have a portion configured to contact a housing of a mating electrical connector during connection of the electrical connector to the mating electrical connector which, after the first male contact blade makes electrical contact with a deflectable beam of a mating contact in the mating electrical connector and after a majority of insertion of the first male contact blade into the mating electrical connector, and during further insertion of the ground contact into the housing of the mating electrical connector contact, causes the first male contact blade to move in a direction to increase deflection of the deflectable beam and thereby increase or maintain normal force between the deflectable beam and the first male contact blade.

12. An electrical connector as in claim 11 where the portion comprises a lateral jog proximate a rear end of the first male contact blades.

13. An electrical connector as in claim 11 where the ground contacts have a cross sectionally flat shape, and where the portion comprises a bent portion of the cross sectionally flat shaped first male contact blade.

14. An electrical connector as in claim 13 where the portion comprise a general lateral extending arc shape.

15. An electrical connector as in claim 11 where the first male contact blade is substantially straight except for the portion, where the portion extends laterally outward from a center axis of the substantially straight first male contact blade between coaxially aligned front and rear sections of the first male contact blade which are located on opposite ends of the portion.

16. An electrical connector as in claim 11 where the portion is sized and shaped to cause the first male contact blade to pivotably deflect in a general cantilever fashion proximate a rear end of the first male contact blade as the portion contacts and moves along the housing of the mating electrical connector.

17. An electrical connector as in claim 11 where the second male contact blades of the signal contacts are straight without the portion.

18. An assembly comprising:

an electrical connector as in claim 11; and a mating electrical connector connected to the electrical connector, where the mating electrical connector comprises a housing with contact channels, and mating contacts with deflectable beams.

19. An assembly as in claim 18 where the mating contacts comprise mating ground contacts having their respective deflectable beams on only one side of the first ground contacts.

20. A method comprising:

inserting first male contact blades of a plurality of ground contacts of a first electrical connector into first contact channels of a second electrical connector; and inserting second male contact blades of a plurality of signal contacts of the first electrical connector into second contact channels of the second electrical connector, where the ground and signal contacts are formed from one or more sheet metal members having a same thickness such that the first and second male contact blades have a substantially same thickness, where, after the first and second male contact blades have moved deflectable beams of mating contacts of the second electrical connector and slid along the deflectable beams along a majority of length of the first and second male contact blades, a portion of the first male contact blades contacts a housing of the second electrical connector and, with further insertion of the first male contact blade into the second electrical connector, the portion and the housing cause the first male contact blade to deflect and move the respective deflectable beams to increase or maintain normal force.

21. An electrical connector comprising:

a housing; and a plurality of first contacts connected to the housing, where the first contacts each comprise a first end configured to be connected to a first component and a second end, where the second end forms a male contact blade configured to be inserted into a contact channel of a housing of a mating electrical connector, where the male contact blade is configured to make a removable connection with a deflectable beam of a mating contact of the mating electrical connector, where the male contact blade has a portion configured to contact the housing of the mating electrical connector during connection of the electrical connector to the mating electrical connector, after the male contact blade makes electrical contact with the deflectable beam, to move the male contact blade in the contact channel, increase deflection of the deflectable beam by the male contact blade, and increase or maintain normal force between the mating contact and the contact generally perpendicular to a direction of insertion of the male contact blade into the contact channel.

* * * * *